US012325950B2

(12) United States Patent
Clare

(10) Patent No.: US 12,325,950 B2
(45) Date of Patent: Jun. 10, 2025

(54) PORTABLE GOLF GLOVE MOUNTING AND DRYING DEVICE

(71) Applicant: Michael Clare, Tampa, FL (US)

(72) Inventor: Michael Clare, Tampa, FL (US)

( * ) Notice: Subject to any disclaimer, the term of this patent is extended or adjusted under 35 U.S.C. 154(b) by 726 days.

(21) Appl. No.: 17/699,372

(22) Filed: Mar. 21, 2022

(65) Prior Publication Data

US 2022/0298719 A1 Sep. 22, 2022

Related U.S. Application Data

(60) Provisional application No. 63/164,052, filed on Mar. 22, 2021.

(51) Int. Cl.
*D06F 59/04* (2006.01)
*A63B 55/00* (2015.01)

(52) U.S. Cl.
CPC ..... *D06F 59/04* (2013.01); *A63B 55/408* (2015.10)

(58) Field of Classification Search
CPC ... D06F 59/04; A63B 55/408; A63B 2209/08; A63B 2209/10; A63B 57/60; A63B 57/20
USPC ..... 34/103
See application file for complete search history.

(56) References Cited

U.S. PATENT DOCUMENTS 5,177,881 A 1/1993 Moore
6,546,599 B2 4/2003 Pelt et al.
8,146,209 B2 * 4/2012 Carnate ..... A45F 5/06 40/667
11,952,708 B1 * 4/2024 Henry ..... F26B 9/003
2002/0138953 A1 10/2002 Passafiume
2003/0029006 A1 * 2/2003 Pelt ..... A45F 5/06 24/442
2004/0134040 A1 * 7/2004 Lazzara ..... A45F 5/02 24/3.12
2005/0120579 A1 * 6/2005 Nicholson ..... A63B 71/146 34/106
2012/0012624 A1 * 1/2012 Marrero ..... A63B 57/20 224/660
2020/0316442 A1 * 10/2020 Wisnom ..... A63B 57/20

OTHER PUBLICATIONS

International Search Report (ISR) for PCT/US2022/021095 dated Jun. 22, 2022 (2 pages).
Written Opinion for PCT/US2022/021095 dated Jun. 22, 2022 (6 pages).

* cited by examiner

*Primary Examiner* — John P McCormack
(74) *Attorney, Agent, or Firm* — Jason A. Smith; Shumaker, Loop & Kendrick, LLP

(57) ABSTRACT

A portable golf glove mounting and drying device including an elongate woven fabric sheath having two spaced apart ends, two spaced apart sides, a front planar face, and a back planar face, with a second end of the two spaced apart ends being permanently enclosed; a golf glove mounting member permanently affixed on an outermost surface of the front planar face of the elongate woven fabric sheath, the golf glove mounting member configured for temporary attachment of a golf glove thereto for a predetermined time period for air and/or wind drying of the golf glove; and a magnet either removably or permanently positioned within the elongate woven fabric sheath.

17 Claims, 10 Drawing Sheets

PORTABLE GOLF GLOVE MOUNTING AND DRYING DEVICE

TECHNICAL FIELD

The present disclosures generally relates to devices used to dry golf gloves having moisture and/or perspiration thereon, and more specifically, the present disclosures relate to portable golf glove mounting and drying devices designed to temporarily mount and/or attach to, for example, the metallic frame of a golf cart or golf bag in which golf gloves can be temporarily affixed thereto to allow for drying of the golf gloves as desired (e.g., between shots).

BACKGROUND

Golf is a popular participant sport. Widespread use of a golf cart during play has significantly increased in the past 30 years. Modern golf carts typically feature a vertically oriented metallic frame connected to a plastic roof, which provides protection to the rider from direct sun, precipitation or other weather elements. Other golfers walk and carry their clubs or utilize a push cart or trolley, particularly outside the USA.

Golf gloves are used during practice or play, typically in the lead hand, to protect the surface of the hand, and to enhance grip on the golf club so that the club does not twist or torque during impact with the ball. Modern golf glove designs almost universally feature a hook and loop attachment closure at the wrist opening of the glove for improved fit.

Accumulation of perspiration or moisture on leather or synthetic gloves affects grip, which can adversely affect performance, particularly in hot, humid conditions on a golf course. Playing golf in the warm weather months is such that golfers frequently use more than one glove during an 18-hole round.

There is therefore a need for a portable device which can be mounted on the metallic frame of a golf cart or attached to the exterior of a golf bag, and upon which a golf glove(s) can be temporarily hung to assist in airing and drying out the glove material as the golf cart or golf bag travels between shots.

SUMMARY

The disclosed portable golf glove mounting and drying devices address the above mentioned problems and are intended for easy and quick use on golf carts or golf bags during a round of golf, upon which golf gloves may be temporarily mounted to facilitate airing out and drying of the leather or synthetic material while the cart or golf bag travels between golf shots.

In certain aspects, disclosed herein is a portable golf glove mounting and drying device comprising: (a) an elongate woven fabric sheath having two spaced apart ends, two spaced apart sides, a front planar face, and a back planar face, with a second end of the two spaced apart ends being permanently enclosed (e.g., having a, tubular knit construction); (b) a golf glove mounting member permanently affixed on an outermost surface of the front planar face of the elongate woven fabric sheath, the golf glove mounting member configured for temporary attachment of a golf glove thereto for a predetermined time period for air and/or wind drying of the golf glove; and (c) a magnet either removably or permanently positioned within the elongate woven fabric sheath, the magnet configured for temporary attachment to ferrous articles (e.g., rail of golf cart frame) while in use.

In certain aspects, the first end of the elongate woven fabric sheath is either (i) permanently enclosed or (ii) openable and closable (with a desired fastener, for example, a button), and the portable golf glove mounting and drying device comprises an internal cavity defined by inner portions of the first end, inner portions of the second end, inner portions of the two spaced apart sides, and inner portions of the front and back planar faces of the elongate woven fabric sheath. The internal cavity receives the magnet therein.

In certain aspects, the golf glove mounting member comprises a fastening device. In this aspect, the fastening device is a hook and loop fastener permanently affixed on an outermost surface of the front planar face of the elongate woven fabric sheath. The hook and look fastener is complementary with and configured to temporarily engage with a hook and loop fastener on the golf glove for the predetermined time period for air and/or wind drying the golf glove. The hook and loop fastener permanently affixed on the outermost surface of the front planar face of the elongate woven fabric sheath has a longitudinal axis that is parallel to a longitudinal axis of the elongate woven fabric sheath, and peripheral edges of the hook and loop fastener permanently affixed on the outermost surface of the front planar face of the elongate woven fabric sheath are offset and recessed relative to peripheral edges of the front planar face. In certain aspects, the fastening device is permanently adhered to the elongate woven fabric sheath, permanently sewn to the elongate woven fabric sheath, or a combination thereof.

In further aspects, a second fastening device may be included that temporarily engages with the first end of the elongate woven fabric sheath that is configured for temporary attachment to a golf bag, a belt loop, or a combination thereof. In certain aspects, the second fastening device is a carabiner clip.

In certain aspects, the first end of the elongate woven fabric sheath further comprises a loop permanently attached to the elongate woven fabric sheath, the loop extends along the longitudinal axis of the elongate woven fabric sheath in a direction away from the second end of the elongate woven fabric sheath and is configured for temporary attachment of a second fastening device thereto.

In certain aspects, all outermost surfaces of the elongate woven fabric sheath are water repellent and/or waterproof. In particular, the elongate woven fabric sheath made be formed or hydrophobic yarns and/or threads that are water repellent and/or waterproof, and/or all outermost surfaces of the elongate woven fabric sheath may be coated and/or surface treated with a water repellent and/or waterproof coating.

In certain aspects, the magnet is removable from the portable golf glove mounting drying device, and the magnet comprises two planar faces with a hook and loop fastener permanently positioned on a first planar face of the two planar faces. In this aspect, the hook and loop fastener permanently positioned on the first planar face of the two planar faces is configured to temporarily engage with a hook and loop fastener on the golf glove and the second planar face of the magnet is configured for temporary attachment to the ferrous article for the predetermined time period for air drying the golf glove.

In additional aspects, an elongate hook and loop fastener may be removably positioned within the elongate woven fabric sheath that is configured to temporarily engage with a hook and loop fastener on the golf glove. In this aspect, the elongate hook and loop fastener removably positioned within the elongate woven fabric sheath includes an adhesive that is configured to temporarily adhere to a desired surface.

Also disclosed herein are methods for drying golf gloves by using the portable golf glove mounting and drying device disclosed herein. The methods include, for example, (a) temporarily fastening a moist golf glove to the portable golf glove mounting and drying device, the portable golf glove mounting and drying device is temporarily affixed to a golf cart, a belt loop, and/or a golf bag; and (b) drying the moist golf glove for a predetermined time period while temporarily affixed to the golf cart, the belt loop, or the golf bag such that the golf glove is sufficiently dry to grip a golf club. In certain aspects, the method further includes, during step (b), moving the golf cart, belt loop, and/or golf bag such that the golf glove is air and/or wind dried.

Also disclosed herein are kits for drying golf gloves. The kits include: (a) portable golf glove mounting and drying device comprising: (i) an elongate woven fabric sheath with two spaced apart ends, with two spaced apart sides and a front planar face and a back planar face, with a second end of the two spaced apart ends having an endless, tubular knit construction; (ii) a golf glove mounting member permanently affixed on an outermost surface of the front planar face of the elongate woven fabric sheath, the golf glove mounting member configured for temporary attachment of a golf glove thereto for a predetermined time period for air and/or wind drying of the golf glove; and (iii) an internal cavity formed within the elongate woven fabric sheath that is defined by inner portions of the first end, inner portions of the second end, inner portions of the two spaced apart sides, and inner portions of the front and back planar faces of the elongate sheath, and (b) a magnet that is removable from the internal cavity of the elongate woven fabric sheath, the internal cavity comprising two planar faces with a hook and loop fastener permanently positioned on a first planar face of the two planar faces that is configured to temporarily engage with a hook and loop fastener on the golf glove and a second planar face of the magnet is configured for temporary attachment to the ferrous article for the predetermined time period for air drying the golf glove.

In certain aspects, the kits further include (c) a carabiner clip configured to attach the elongate woven fabric sheath to a golf bag or belt loop.

Embodiments of the invention can include one or more or any combination of the above features and configurations.

Additional features, aspects and advantages of the invention will be set forth in the detailed description, which follows, and in part will be readily apparent to those skilled in the art from that description or recognized by practicing the invention as described herein. It is to be understood that both the foregoing general description and the following detailed description present various embodiments of the invention, and are intended to provide an overview or framework for understanding the nature and character of the invention as it is claimed. The accompanying drawings are included to provide a further understanding of the invention, and are incorporated in and constitute a part of this specification.

BRIEF DESCRIPTION OF THE DRAWINGS

These and other features, aspects and advantages of the present invention are better understood when the following detailed description of the invention is read with reference to the accompanying drawings, in which:

FIG. 10A, FIG. 10B, and FIG. 10C each depict an alternative embodiment of the device in which the magnet is permanently enclosed within the device, wherein FIG. 10A depicts a back view of this embodiment; FIG. 10B depicts a cutaway view of this embodiment showing the magnet permanently enclosed therein, and FIG. 10C depicts a front view of this embodiment.

DETAILED DESCRIPTION

The present invention will now be described more fully hereinafter with reference to the accompanying drawings in which exemplary embodiments of the invention are shown. However, the invention may be embodied in many different forms and should not be construed as limited to the representative embodiments set forth herein. The exemplary embodiments are provided so that this disclosure will be both thorough and complete, and will fully convey the scope of the invention and enable one of ordinary skill in the art to make, use and practice the invention. Like reference numbers refer to like elements throughout the various drawings.

Golf is a popular participant sport, both in the USA and throughout much of the world. Golf carts are commonly used during a round of golf to not only carry a golfer's clubs, but also to transport golfers between shots. Some golfers walk and carry their clubs in their bag or transport their clubs on a push cart or trolley. Golfers commonly wear a golf glove on the lead hand (left hand for a right-handed player), and a small percentage of players wear gloves on both hands. Golf gloves serve to protect the surface of the lead hand, and enhance grip on the club while playing a shot. Accumulation of perspiration on the golf glove during play affects grip, which can adversely impact performance, particularly in hot and humid conditions frequently encountered on a golf course.

FIGS. 1A-10C depict the portable golf glove mounting and drying devices (100, 100') disclosed herein, which advantageously address the above-mentioned problems. These devices (100, 100') are intended for use on golf carts, golf bags, or belt loops during a round of golf, and upon which golf gloves may be temporarily affixed and/or mounted to facilitate airing out and drying of the leather or synthetic material while the cart or golf bag travels between golf shots.

Figure 1C:
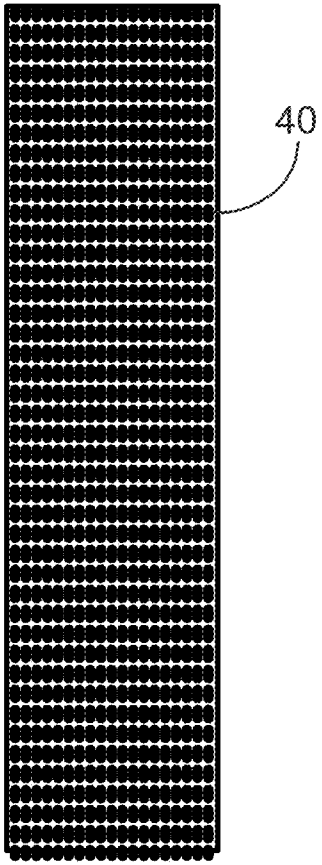
FIG. 1C is a back view of the magnet depicted in FIGS. 1A and 1B that includes a hook and loop fastener positioned thereon.
Figure 1B:
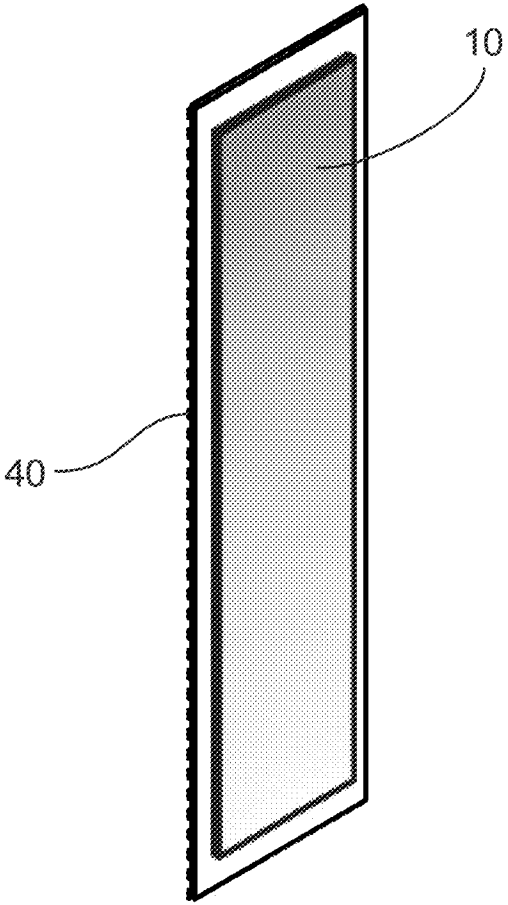
FIG. 1B is a perspective view of the magnet depicted in FIG. 1A.
Figure 1A:
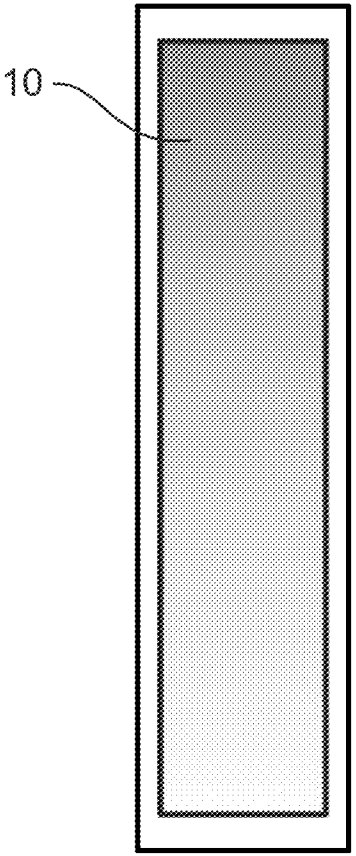
FIG. 1A depicts a front view of a magnet used within the portable golf glove mounting and drying device.

In each preferred embodiment of the mounting and drying devices (100, 100') disclosed herein, a magnet (10) is included. The magnet may be permanently included within the device (100') (e.g., the elongate woven fabric sheath (110) discussed further below) or may be removable (100) therefrom (e.g., when the magnet is removable from the elongate sheath, it is separately usable for drying golf gloves as disclosed further below). FIG. 1A depicts a front view of an exemplary magnet (10) used within the portable golf glove mounting and drying device. FIG. 1B is a perspective view of the magnet (10) depicted in FIG. 1A having fasteners (hook and loop fasteners) (40) permanently positioned thereon. FIG. 1C is a back view of the magnet (10) depicted in FIGS. 1A and 1B that includes a hook and loop fastener (40) permanently positioned thereon. The magnet (10) depicted in FIGS. 1A-1C is removable from the elongate woven fabric sheath (110) and may be separately usable from the elongate woven fabric sheath (110) to dry the golf gloves (200) as shown, for example, in FIGS. 6-8. In certain instances and as further shown in FIGS. 10A-10C, the magnet (10) is permanently included in elongate woven fabric sheath (110), and in this aspect, the hook and loop fasteners (40) are excluded/not permanently positioned on the magnet as they would serve no purpose since the magnet is permanently positioned inside the sheath.

With specific reference to FIGS. 3A-4 and FIGS. 9-10C, disclosed herein are portable golf glove mounting and drying devices (100, 100') that include (a) an elongate woven fabric sheath (110) with two spaced apart ends (112, 114), two spaced apart sides (121, 122), a front planar face (120), and a back planar face (130), wherein a second end (114) of the two spaced apart ends is permanently enclosed; (b) a golf glove mounting member (140) is permanently affixed on an outermost surface (128) of the front planar face (120) of the elongate woven fabric sheath (110), the golf glove mounting member is configured for temporary attachment of a golf glove (200) thereto for a predetermined time period for air and/or wind drying of the golf glove; and (c) a magnet (10) either removably (FIGS. 4 and 6-8) or permanently (FIGS. 10A-10C) positioned within the elongate woven fabric sheath (110). The magnet is configured for temporary attachment to ferrous articles while the device is in use.

Figure 3A:
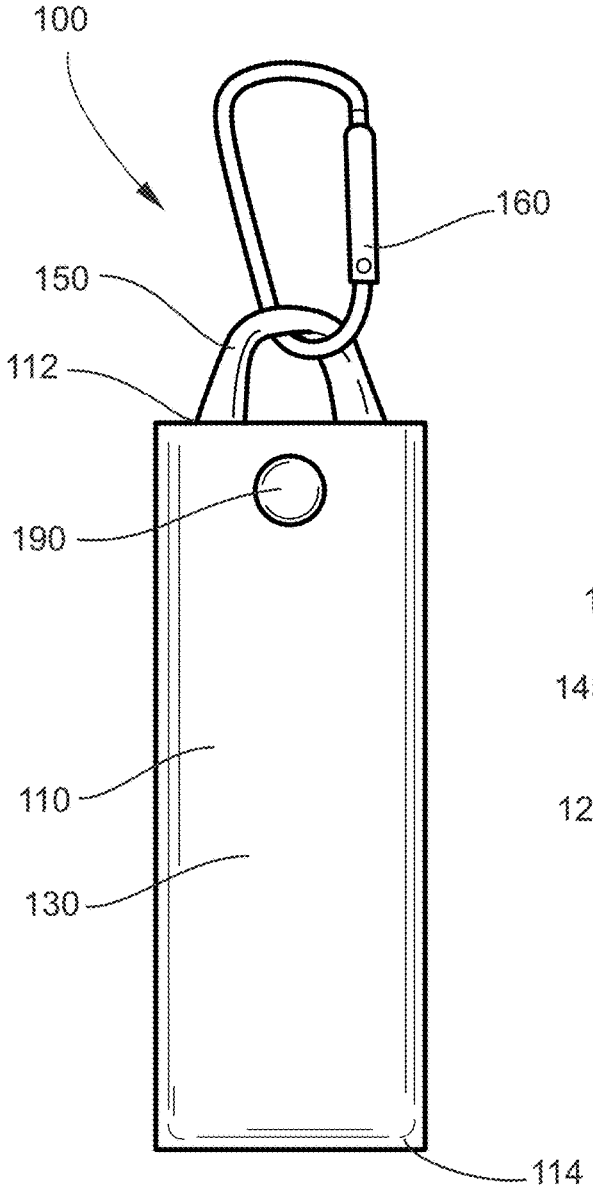
FIG. 3A and FIG. 3B respectively depict a back view and a front view of the elongate woven fabric sheath of the portable golf glove mounting and drying device.
Figure 3B:
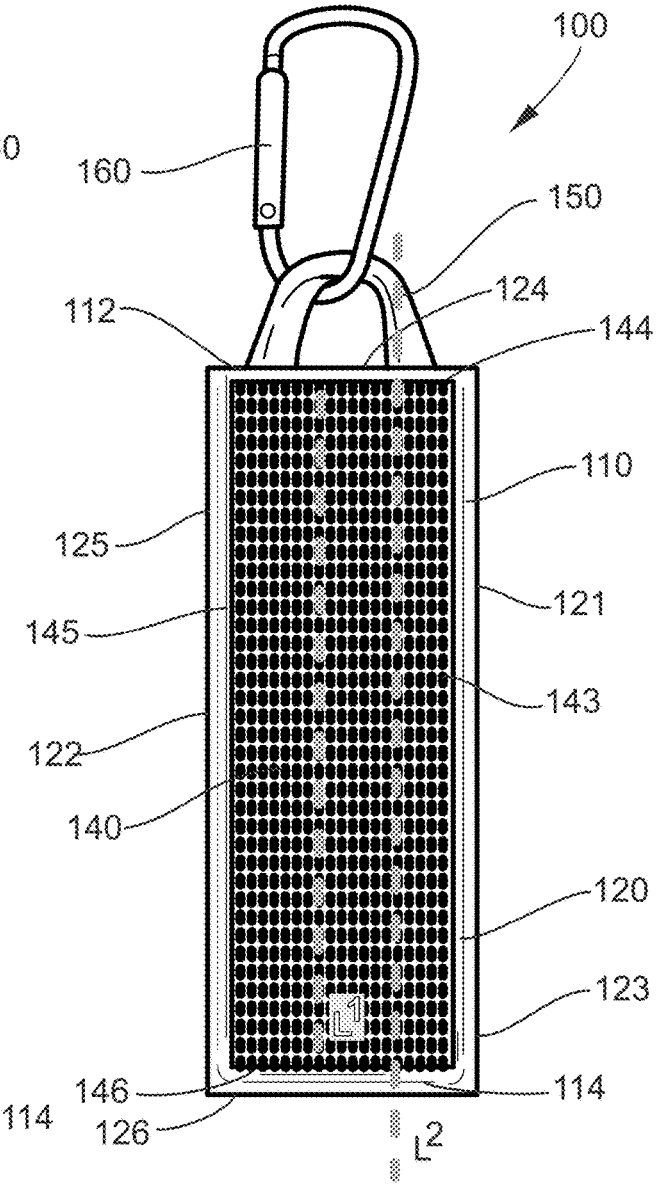
Figure 4:
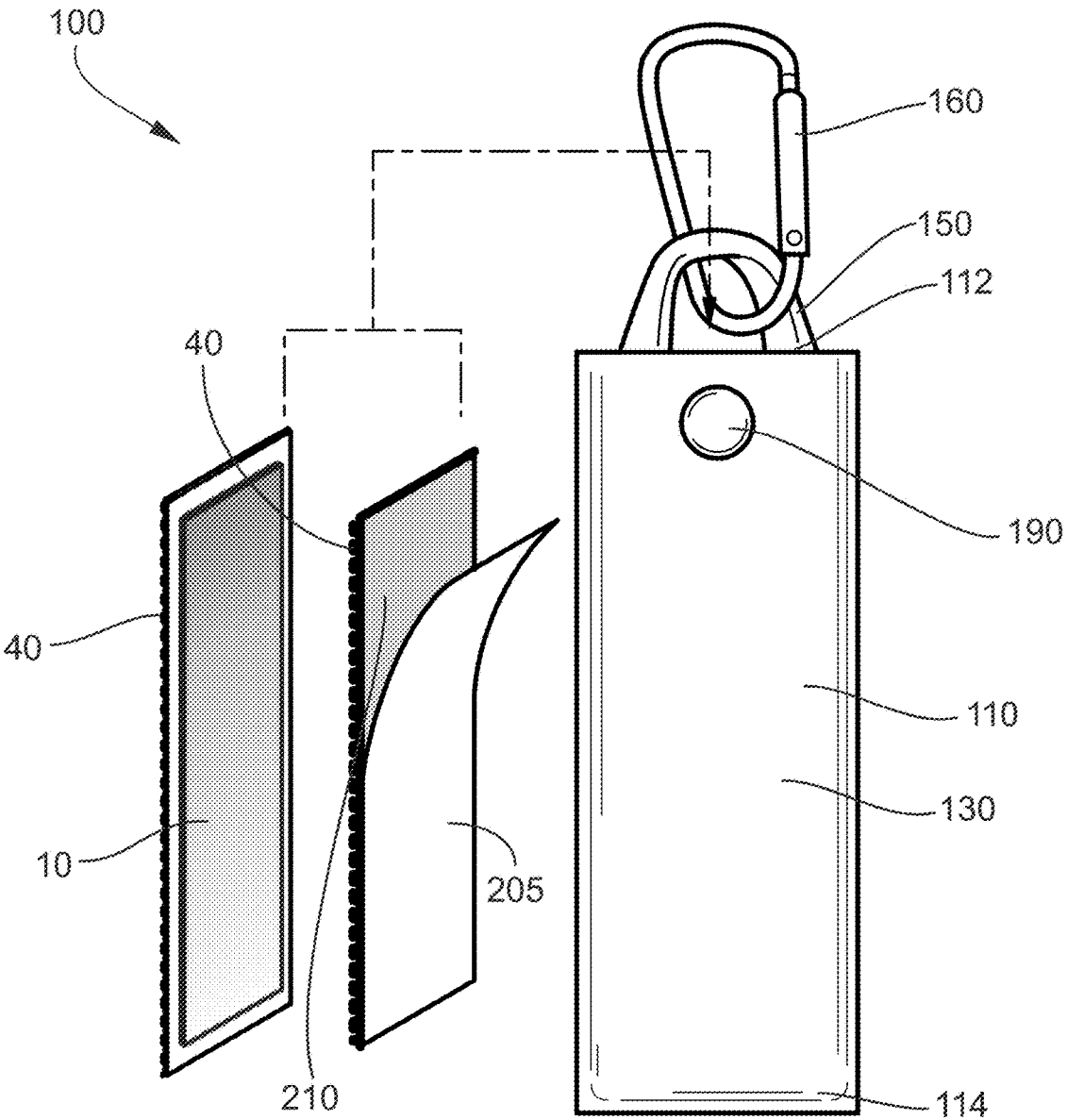
FIG. 4 depicts the elongate woven fabric sheath of FIGS. 3A and 3B in which the magnet of FIGS. 1A-1C and/or the hook and loop fastener of FIGS. 2A-2C are removably inserted therein.
Figure 10C:
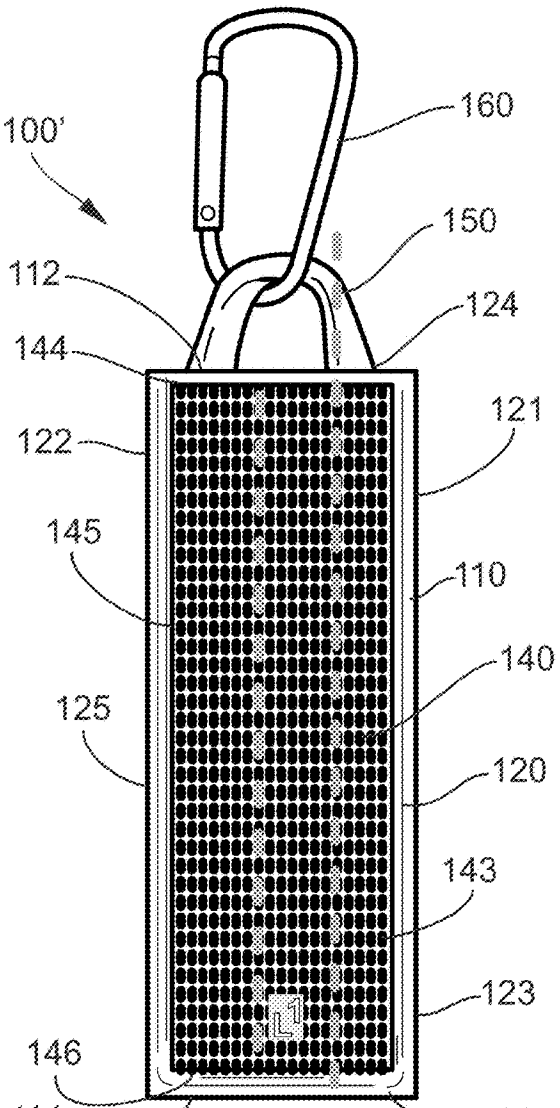

As shown in FIGS. 3B and 10C, the golf glove mounting member (140) is a fastening device (141) (a hook and loop fastener) permanently affixed on an outermost surface of the front planar face (120) of the elongate woven fabric sheath (110). The fastening device (141) (hook and loop fastener) is complementary with and configured to temporarily engage with a hook and loop fastener on the golf glove for the predetermined time-period for air and/or wind drying the golf glove. As further shown in FIGS. 3B and 10C, the hook and loop fastener has a longitudinal axis (L') that is parallel to a longitudinal axis ($L^2$) of the elongate woven fabric sheath such that the longest portions of the mounting member (140)/fastening device (141) (hook and loop fastener) and the longest portions of the elongate woven fabric sheath are aligned with one another in a lengthwise manner. As further shown in FIGS. 3B and 10C, peripheral edges (143-146) of the hook and loop fastener are offset and recessed relative to peripheral edges (123-126) of the front planar face (120) of the elongate woven fabric sheath (110). The positioning and dimensions of the hook and loop fasteners of the fastening device (141) prevent and/or reduce premature wear and tear of the hook and loop fasteners on the device (100, 100') as well as dissociation/separation of the hook and loop fasteners from the elongate woven fabric sheath. In certain aspects, the fastening device (141) (hook and loop fastener) is permanently adhered to the elongate woven fabric sheath (110), permanently sewn to the elongate woven fabric sheath (110), or a combination thereof.

As further shown in FIGS. 3A, 3B, 9, and 10A-10C, the first end (112) of the elongate woven fabric sheath (110) further includes a loop (150) permanently attached to the elongate woven fabric sheath (110) that extends along the longitudinal axis ($L^2$) of the elongate woven fabric sheath (110) in a direction away from the second end (114) of the elongate woven fabric sheath (110). The loop (150) is preferably flexible and pliable so that the device (100, 100') may be easily handled while in use and may be easily attached to, for example, a second fastener (160), a golf bag (300) as shown, for example, in FIG. 5A, etc. As further shown in FIGS. 3A, 3B, 9, and 10A-10C, the loop (150) is configured for temporary attachment of a second fastening device (160) thereto. In certain aspects, the second fastening device (160) is preferably a carabiner, which further allows for the elongate woven fabric sheath (110) of the device (100, 100') to be quickly temporarily attached to a golf bag, belt loop, or any other surface configured for attachment/hooking thereon while in use and to be quickly removed once use has concluded.

To further increase durability and lifespan of the portable golf glove mounting and drying devices (100, 100'), portions of the device may be water repellent and/or waterproof. These characteristics may be achieved by using hydrophobic threads to form portions of the device and/or via surface treatments providing water repellent coating and/or waterproof coatings to portions of the device. Water repellent and/or waterproof coatings may include application of fluorocarbons and/or organofluorine chemicals (e.g., perfluorobutanesulfonic acid) known to impart these features. In certain preferred aspects, all outermost surfaces of the elongate woven fabric sheath (110) are water repellent and/or waterproof. This is preferred to maintain any internal contents (discussed further below) positioned within the elongate woven fabric sheath dry, especially during inclement weather conditions, and to further increase overall durability of the device (100, 100').

Figure 2C:
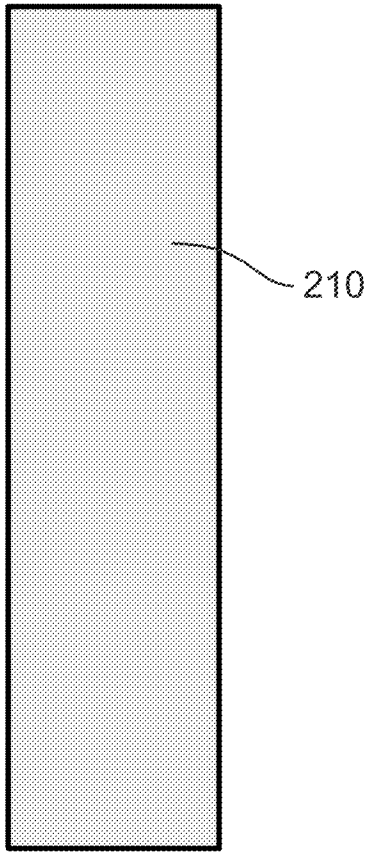
FIG. 2C is a back view of the hook and loop fastener depicted in FIGS. 2A and 2B depicting the adhesive and having the removable backing completely removed.
Figure 2B:
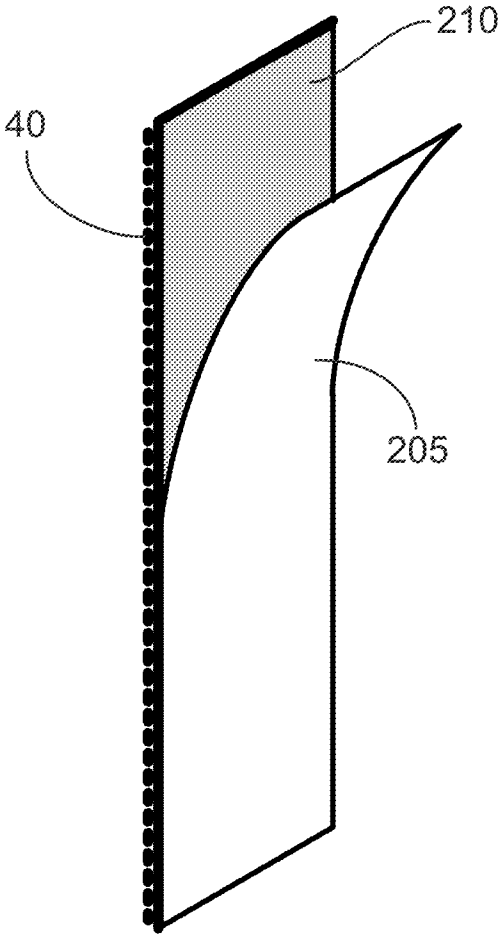
FIG. 2B is a perspective view of the hook and loop fastener of FIG. 2A further depicting an adhesive applied on a back side of the hook and loop fastener as well as a removable backing.
Figure 2A:
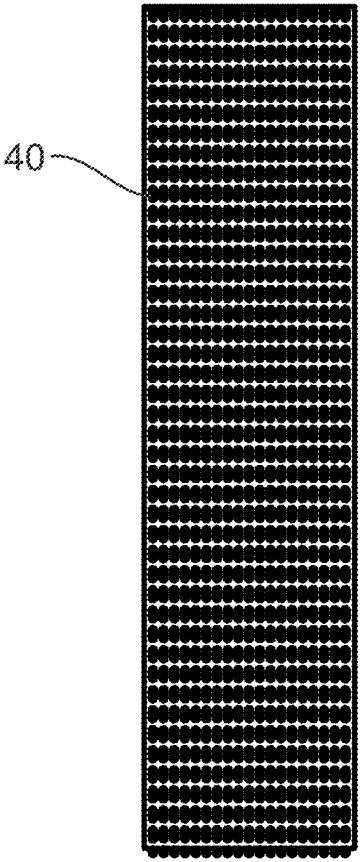
FIG. 2A is a front view of another hook and loop fastener.
Figure 10B:
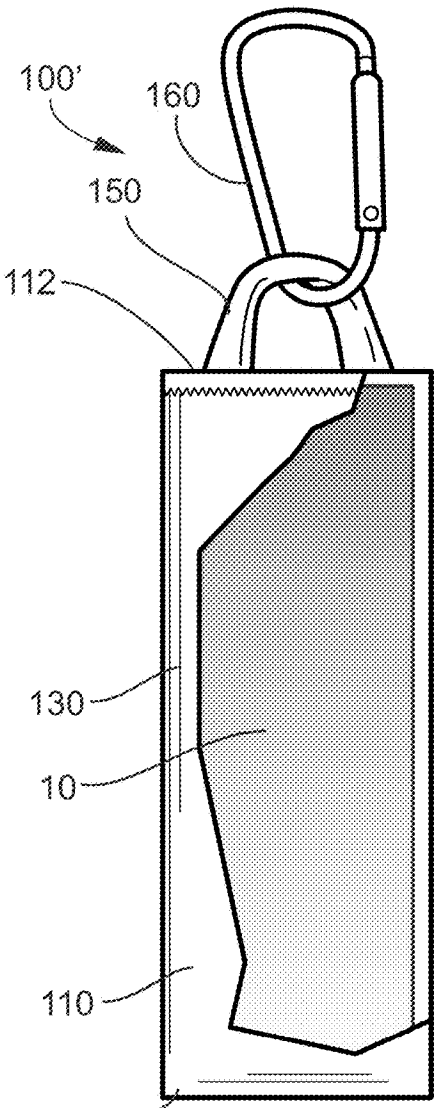
Figure 10A:
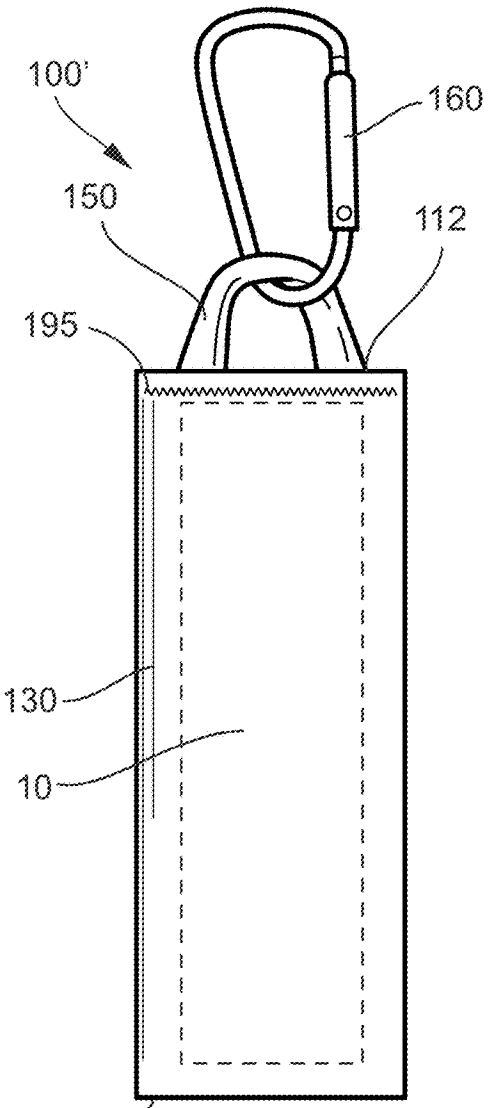

With regard to the internal contents of the device, it should be noted that the first end (112) of the elongate woven fabric sheath (110) is either (i) permanently enclosed such that no contents (magnet (10)) positioned internally therein may be accessed (FIGS. 10A-10C) or (ii) openable and closable so that contents positioned internally within the sheath may be accessed (FIGS. 3A-3C). For example, the elongate sheath (110) depicted in FIGS. 3A-3C is openable and closable via a fastener (190) (e.g., a button, zipper, or hook and loop fastener) positioned adjacent to the first end (112) that allows for the first end (112) of the elongate woven fabric sheath to be opened and closed and for contents (e.g., magnets and hook and loop fasteners depicted in FIGS. 1A-2C) internally positioned within the elongate sheath (110) to be accessed by the device (100) user. Alternatively and as further depicted in FIGS. 10A-10C, both ends (112, 114) of the elongate sheath may be permanently closed such that no contents positioned internally within the sheath may be accessed. As shown in FIGS. 10A and 10B, the permanent enclosure (195) of the first end may be achieved by stitching, an adhesive, or an endless tubular knit. In each of the above embodiments and as further depicted in FIGS. 4, 9, and 10B, the portable golf glove mounting and drying device (100, 100') comprises an internal cavity defined by inner portions of the first end (112), inner portions of the second end (114), inner portions of the two spaced apart sides (121, 122), and inner portions of the front and back planar faces (120, 130) of the elongate woven fabric sheath. The internal cavity receives the magnet (10) therein.

When the elongate sheath (110) depicted in FIGS. 3A-3C is openable and closable via the fastener (190), the magnet (10) having the hook and loop fastener (40) as shown in FIGS. 1A and 1B may be temporarily positioned therein (received within the elongate sheath's internal cavity) and may be removed therefrom as desired by the device user. In certain additional aspects when the elongate sheath (110) depicted in FIGS. 3A-3C is openable and closable via the fastener (190), and as shown in FIGS. 2A-2C and FIG. 4, it should be further appreciated that an additional hook and loop fastener may be provided, received within the elongate sheath's internal cavity, and may be removed therefrom as desired by the device user. The hook and loop fastener depicted in FIGS. 2A-2C includes an adhesive (210) applied on a backside of the hook and loop fastener as well as a removable backing (205). In certain aspects and when the first end (112) of the elongate woven fabric sheath is configured for opening and closing, the internal cavity formed in the elongate woven fabric sheath is configured to further receive the user's small personal items such as credit cards and/or currency.

FIGS. 5A-8 generally depict the device (100, 100') or portions thereof in use. FIGS. 5A-8 specifically depict methods of drying golf gloves (200) by (a) temporarily fastening a moist golf glove to the portable golf glove mounting and drying device (100, 100'), the portable golf glove mounting and drying device is temporarily affixed to a golf cart (400—frame/rail on golf cart), a belt loop, or a golf bag (300); and (b) drying the moist golf glove for a predetermined time period while temporarily affixed to the golf cart, the belt loop, or the golf bag such that the golf glove is sufficiently dry to grip a golf club.

Figure 5A:
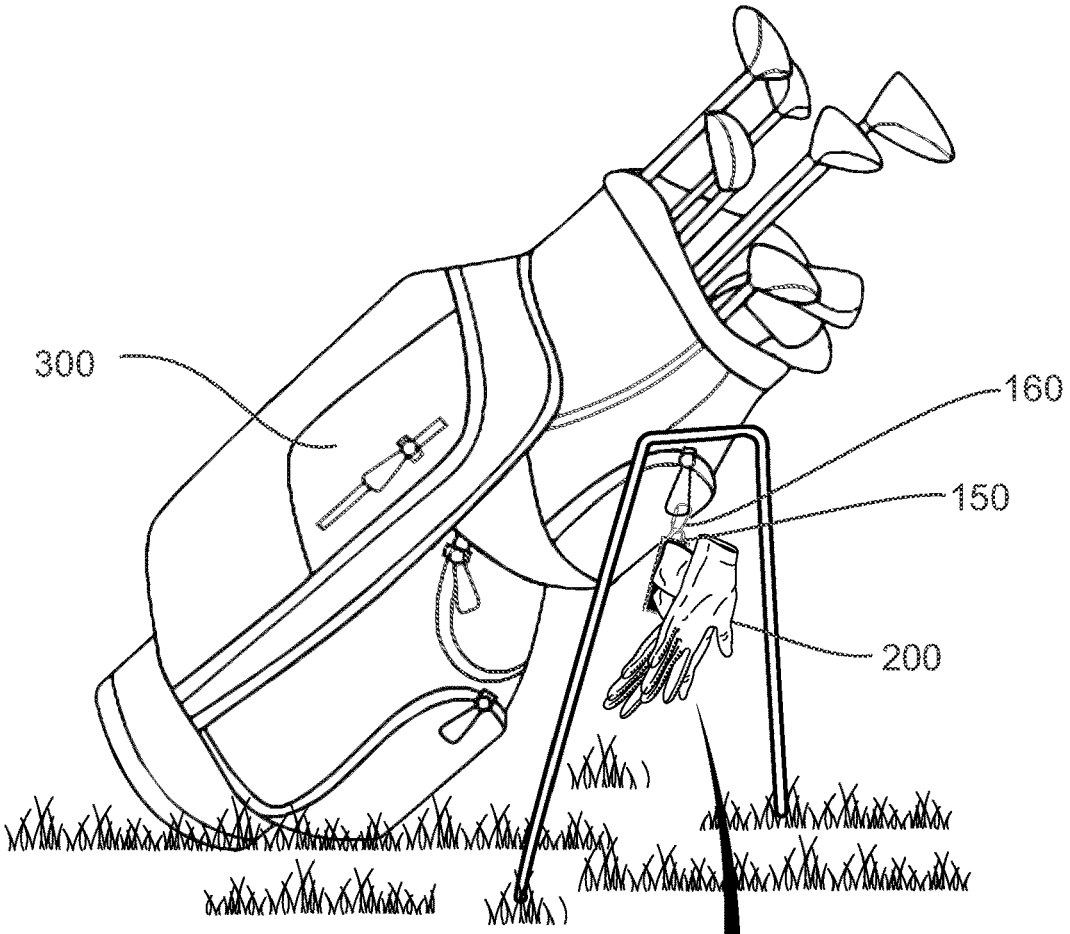
FIG. 5A depicts the portable golf glove mounting and drying device temporarily attached to a golf bag and having golf gloves attached and drying thereon.
Figure 5B:
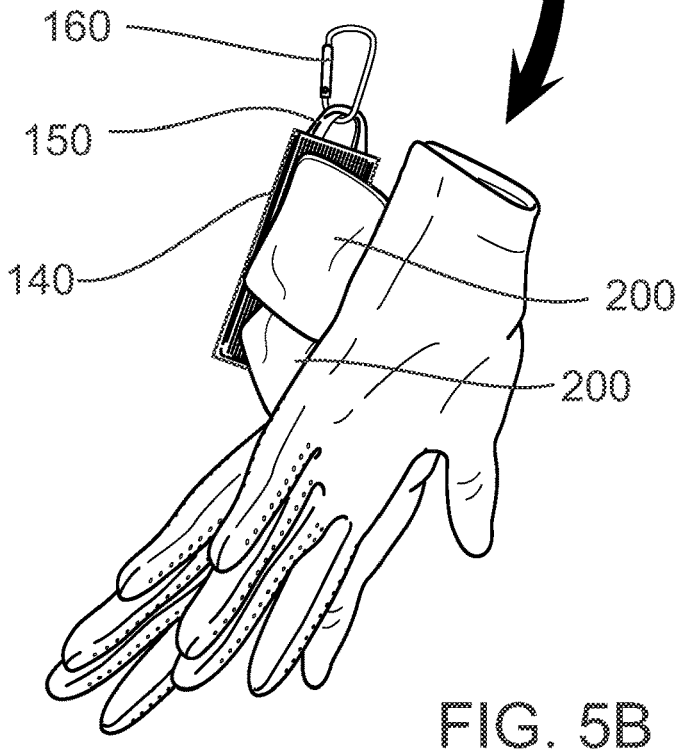
FIG. 5B is a magnified view of FIG. 5A.

With specific reference to FIGS. 5A and 5B, the device (100, 100') is attached to a golf bag via loop (150) and second fastening device (160) (carabiner). One or more golf gloves (200) are temporarily but securely attached to golf glove mounting member (140) (hook and loop fasteners that engage complementary hook and loop fasteners on the golf gloves) for a desired time-period to allow the golf gloves to wind and/or air dry. When the gloves (200) are attached to the device as depicted in FIG. 5A, the gloves (200) may be attached to the device in numerous different ways/orientations (e.g., in a "palms out" or "palms in" configuration) to optimize airflow into the glove to further facilitate and expedite glove drying.

Figure 6:
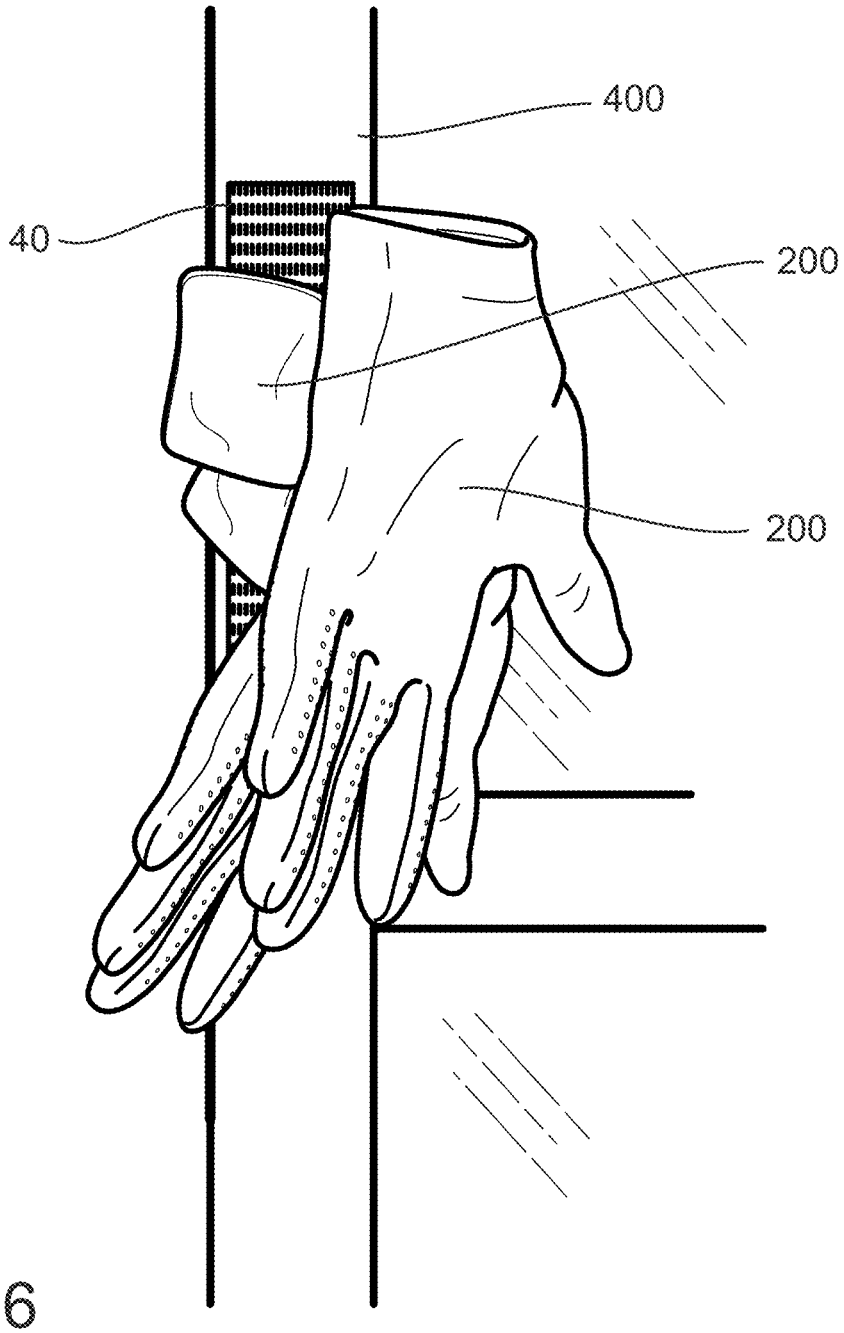
FIG. 6 depicts the magnet of FIGS. 1A-1C and/or the hook and loop fastener of FIGS. 2A-2C positioned on a golf cart rail (aligned parallel to the longitudinal axis of the cart rail) and having golf gloves attached and drying thereon.
Figure 7:
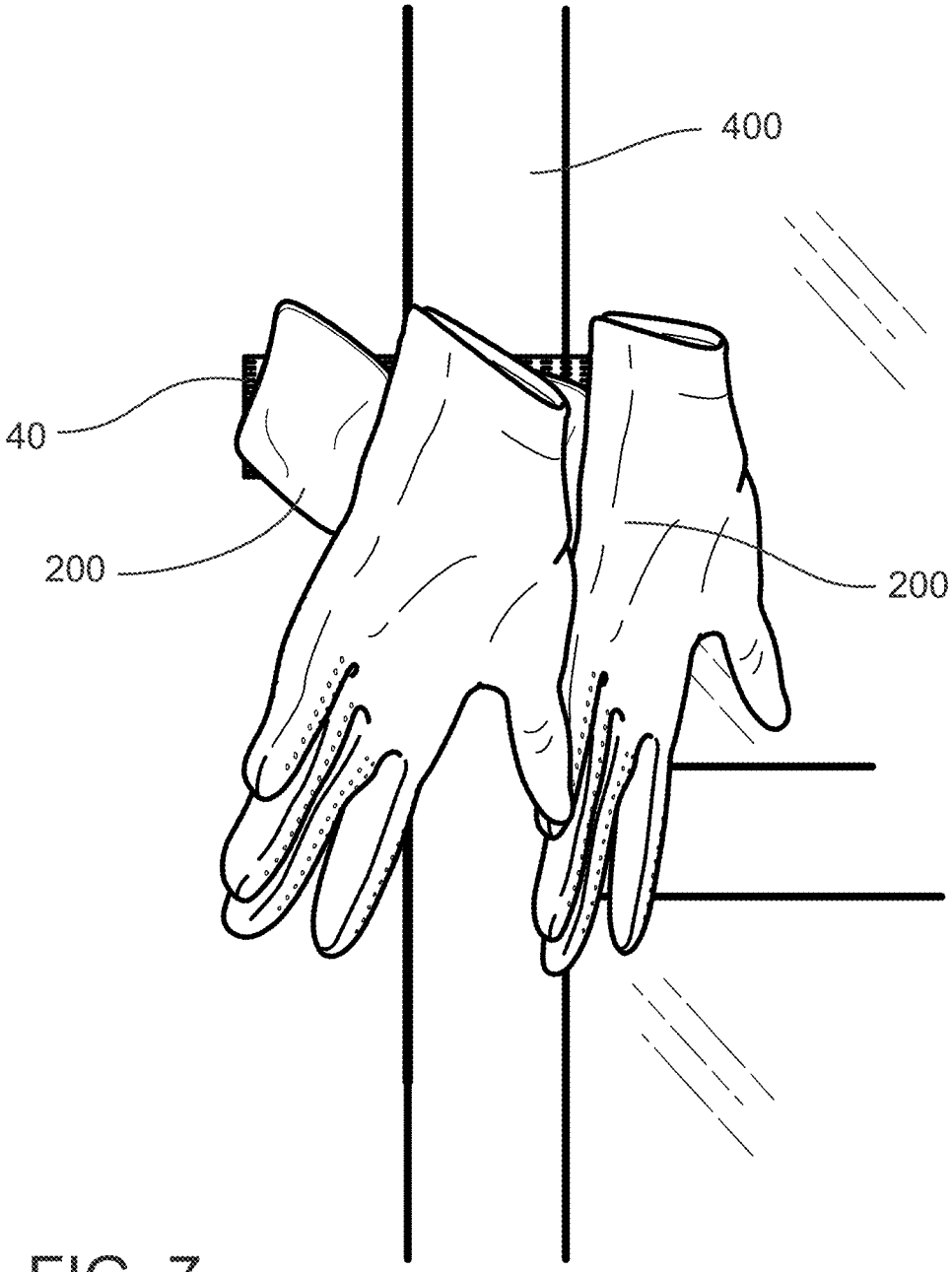
FIG. 7 depicts the magnet of FIGS. 1A-1C and/or the hook and loop fastener of FIGS. 2A-2C positioned on a golf cart rail (perpendicularly aligned relative to the longitudinal axis of the cart rail) and having golf gloves attached and drying thereon.
Figure 8:
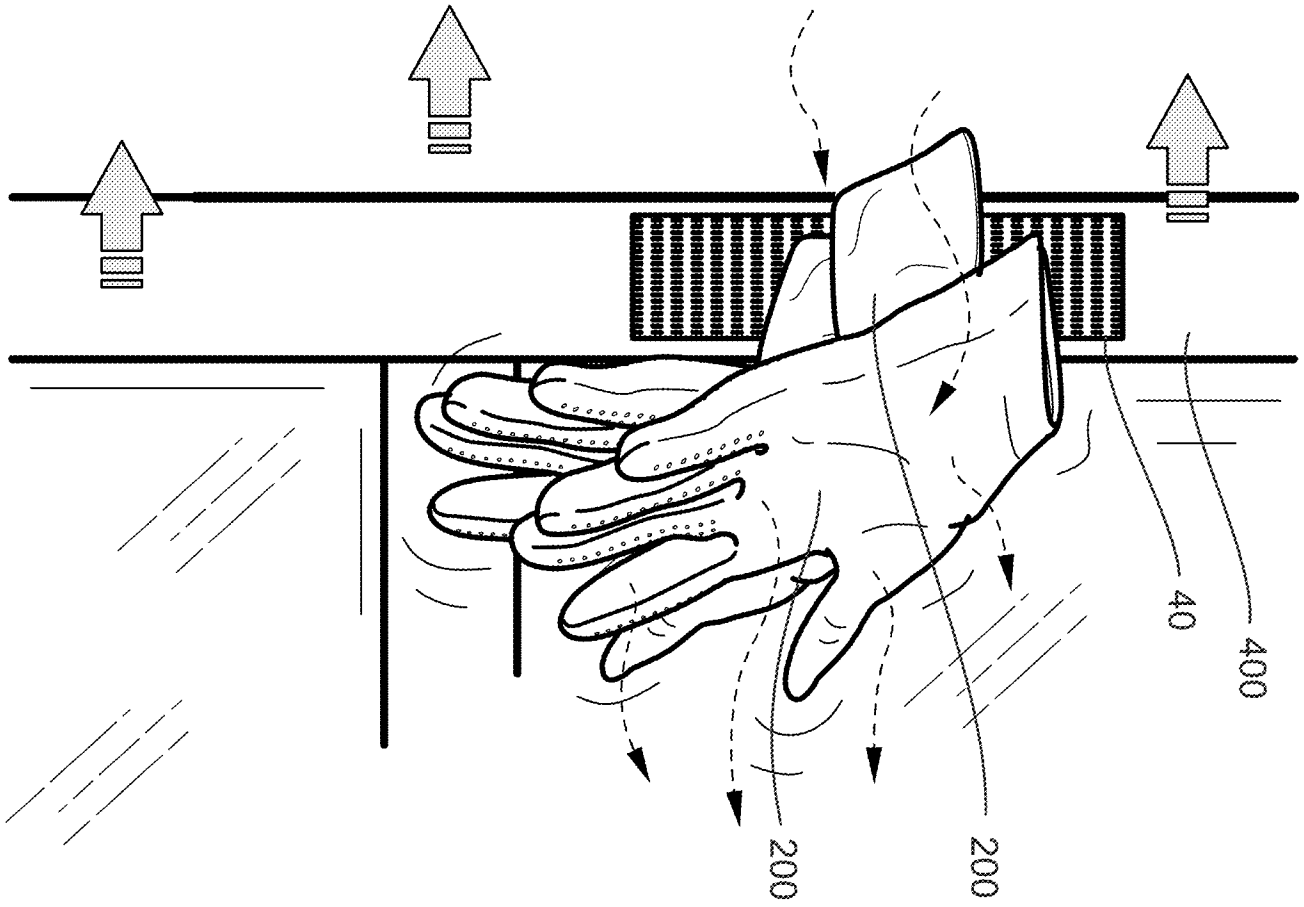
FIG. 8 further depicts FIG. 6 in which the golf cart rail moving in a forward direction (forward arrows) thereby winding drying (backward arrows) the gloves.
Figure 9:
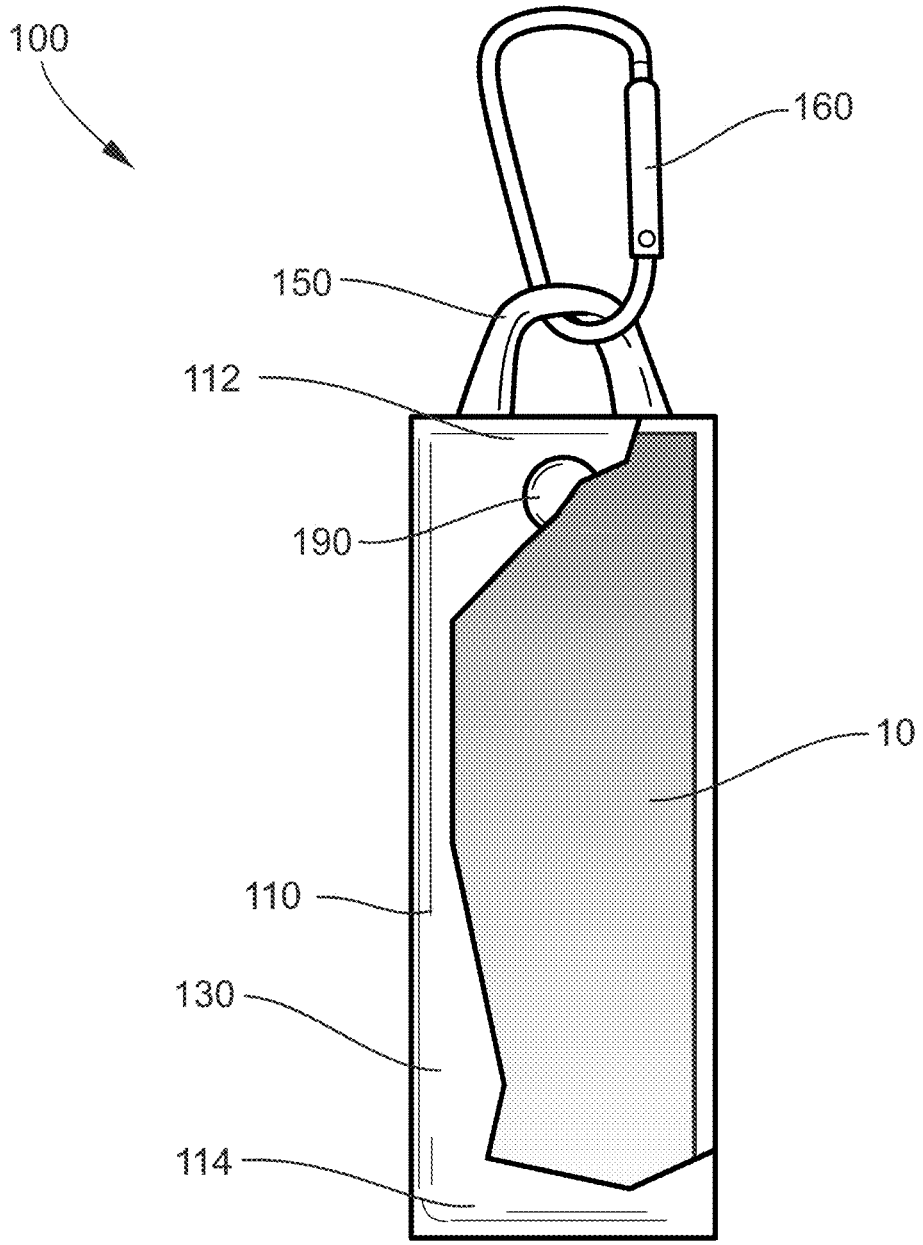
FIG. 9 is a cutaway of the device shown in FIG. 4 having the magnet removably inserted therein.

With specific reference to FIGS. 6-8, the hook and loop fasteners (40) depicted in any of FIGS. 1A-2C have been removed from the elongate woven fabric sheath (110) and have been attached and/or affixed to, for example, a golf cart rail/frame (400). If using the hook and loop fasteners (40) depicted in FIGS. 1A-1C, the magnet (10) should be attached to a ferrous material on the golf cart rail/frame (400) and may be oriented on the golf cart rail/frame (400) as shown in FIGS. 6-8. Alternatively and if using the hook and loop fasteners (40) depicted in FIGS. 2A-2C, the backing (205) may be removed (as shown in FIGS. 2B and 2C) and the hook and loop fasteners (40) may be adhered to any desired surface on the golf cart including the golf cart rail/frame (400) and having the orientation depicted in FIGS. 6-8. When the gloves are attached to the device as depicted in FIGS. 6-8, the gloves (200) may be attached to the device in numerous different ways/orientations (e.g., in a "palms out" or "palms in" configuration) to optimize air flow into the glove to further facilitate and expedite glove drying. FIG. 8 further depicts air and/or wind drying of the gloves when a golf cart is being driven. In particular, the forward arrows shown in FIG. 8 depict the direction (forward direction) in which the golf cart is being drive (and the gloves are being moved) while the backward arrows are indicating wind flow used to dry the gloves (200).

In alternative embodiments, it is envisioned that the device (100') depicted in FIGS. 10A-10C, which includes the magnet (10) permanently enclosed within the elongate woven fabric sheath (110), may be used as shown in FIGS. 5A and 5B. Likewise and because the device (100') of FIGS. 10A-10C includes the magnet (10) permanently enclosed therein, this device (100') may be attached of a ferrous material on a golf cart (e.g., golf cart rail/frame (400)) with golf glove mounting member (140) spaced apart from the golf cart such that the golf gloves (200) may be attached thereto in a desired orientation and allowed to dry.

In certain aspects, the devices disclosed advantageously achieve any one or combination of the following: prevents loss of golf glove during travel between shots; facilitates airing out/drying of glove during travel between shots; air dries glove when stationary by mounting glove in "open" position; width matches width of metallic frame of cart (for more secure attachment to golf cart); length of device allows more than one glove to be mounted; the device is portable and reusable between golf rounds; and is easily stored in pouch or pocket of golf bag between golf rounds.

Also disclosed herein are kits for drying golf gloves. The kits may include any single component of the devices (100, 100') disclosed above and/or any combination of the components disclosed above including the disclosed hook and loop fasteners, second fastening members, elongate woven fabric sheath(s), etc.

The foregoing description provides embodiments of the invention by way of example only. It is envisioned that other embodiments may perform similar functions and/or achieve similar results. Any and all such equivalent embodiments and examples are within the scope of the present invention and are intended to be covered by the appended claims.

What is claimed is:

1. A portable golf glove mounting and drying device comprising:

(a) an elongate woven fabric sheath having two spaced apart ends, two spaced apart sides, a front planar face and a back planar face, wherein a second end of the two spaced apart ends is permanently enclosed;

(b) a golf glove mounting member permanently affixed on an outermost surface of the front planar face of the elongate woven fabric sheath, the golf glove mounting member configured for temporary attachment of a golf glove thereto for a predetermined time period for air and/or wind drying of the golf glove;

(c) a magnet either removably or permanently positioned within the elongate woven fabric sheath, the magnet configured for temporary attachment to ferrous articles while in use; and (d) an elongate hook and loop fastener removably positioned within the elongate woven fabric sheath that is configured to temporarily engage with a hook and loop fastener on the golf glove.

2. The portable golf glove mounting and drying device of claim 1, wherein a first end is either permanently enclosed or openable and closable, and the portable golf glove mounting and drying device comprises an internal cavity defined by inner portions of the first end, inner portions of the second end, inner portions of the two spaced apart sides, and inner portions of the front and back planar faces of the elongate woven fabric sheath, and the internal cavity receives the magnet therein.

3. The portable golf glove mounting and drying device of claim 1, wherein the golf glove mounting member comprises a fastening device.

4. The portable golf glove mounting and drying device of claim 3, wherein the fastening device is a hook and loop fastener permanently affixed on an outermost surface of the front planar face of the elongate woven fabric sheath that is complementary with and configured to temporarily engage with a hook and loop fastener on the golf glove for the predetermined time period for air and/or wind drying the golf glove, the hook and loop fastener has a longitudinal axis ($L^1$) that is parallel to a longitudinal axis ($L^2$) of the elongate woven fabric sheath, and peripheral edges of the hook and loop fastener affixed on the outermost surface of the front planar face are offset and recessed relative to peripheral edges of the front planar face.

5. The portable golf glove mounting and drying device of claim 3, wherein the fastening device is permanently adhered to the elongate woven fabric sheath, permanently sewn to the elongate woven fabric sheath, or a combination thereof.

6. The portable golf glove mounting and drying device of claim 3, further comprising a second fastening device temporarily engaged with the first end of the elongate woven fabric sheath that is configured for temporary attachment to a golf bag, a belt loop, or a combination thereof.

7. The portable golf glove mounting and drying device of claim 6, wherein the second fastening device is a carabiner clip.

8. The portable golf glove mounting and drying device of claim 3, wherein the first end of the elongate woven fabric sheath further comprises a loop permanently attached to the elongate woven fabric sheath, the loop extends along the longitudinal axis of the elongate woven fabric sheath in a direction away from the second end of the elongate woven fabric sheath and is configured for temporary attachment of a second fastening device thereto.

9. The portable golf glove mounting and drying device of claim 1, wherein all outermost surfaces of the elongate woven fabric sheath are water repellent and/or waterproof.

10. The portable golf glove mounting and drying device of claim 1, wherein the elongate hook and loop fastener removably positioned within the elongate woven fabric sheath includes an adhesive that is configured to temporarily adhere the elongate hook and loop fastener to a desired surface.

11. A method of drying golf gloves comprising:

(a) temporarily fastening a moist golf glove to the portable golf glove mounting and drying device of claim 1, the portable golf glove mounting and drying device is temporarily affixed to a golf cart, a belt loop, or a golf bag; and (b) drying the moist golf glove for a predetermined time period while the portable golf glove mounting and drying device is temporarily affixed to the golf cart, the belt loop, or the golf bag such that the golf glove is sufficiently dry to grip a golf club.

12. The method of drying golf gloves of claim 11, further comprising, during step (b), moving the golf cart, belt loop, or golf bag such that the golf glove is air and/or wind dried.

13. A portable golf glove mounting and drying device comprising:

(a) an elongate woven fabric sheath having two spaced apart ends, two spaced apart sides, a front planar face and a back planar face, wherein a second end of the two spaced apart ends is permanently enclosed;

(b) a golf glove mounting member permanently affixed on an outermost surface of the front planar face of the elongate woven fabric sheath, the golf glove mounting member configured for temporary attachment of a golf glove thereto for a predetermined time period for air and/or wind drying of the golf glove; and (c) a magnet either removably or permanently positioned within the elongate woven fabric sheath, the magnet configured for temporary attachment to ferrous articles while in use;

(d) wherein a first end of the two spaced apart ends is either permanently enclosed or openable and closable, and the portable golf glove mounting and drying device comprises an internal cavity defined by inner portions of the first end, inner portions of the second end, inner portions of the two spaced apart sides, and inner portions of the front and back planar faces of the elongate woven fabric sheath, and the internal cavity receives the magnet therein;

(e) wherein the golf glove mounting member comprises a fastening device, the fastening device being a hook and loop fastener permanently affixed on an outermost surface of the front planar face of the elongate woven fabric sheath that is complementary with and configured to temporarily engage with a hook and loop fastener on the golf glove for the predetermined time period for air and/or wind drying the golf glove, the hook and loop fastener has a longitudinal axis ($L^1$) that is parallel to a longitudinal axis ($L^2$) of the elongate woven fabric sheath, and peripheral edges of the hook and loop fastener affixed on the outermost surface of the front planar face are offset and recessed relative to peripheral edges of the front planar face, wherein the fastening device is permanently adhered to the elongate woven fabric sheath, permanently sewn to the elongate woven fabric sheath, or a combination thereof;

(f) wherein the first end of the elongate woven fabric sheath further comprises a loop permanently attached to the elongate woven fabric sheath, the loop extends along the longitudinal axis of the elongate woven fabric sheath in a direction away from the second end of the elongate woven fabric sheath and is configured for temporary attachment of a second fastening device thereto;

(g) wherein the magnet is removable from the portable golf glove mounting and drying device, the magnet comprises two planar faces with a hook and loop fastener permanently positioned on a first planar face of the two planar faces.

14. The portable golf glove mounting and drying device of claim 13, wherein the hook and loop fastener permanently positioned on the first planar face of the two planar faces is configured to temporarily engage with a hook and loop fastener on the golf glove and a second planar face of the magnet is configured for temporary attachment to the ferrous article for the predetermined time period for air drying the golf glove.

15. The portable golf glove mounting and drying device of claim 13, further comprising a second fastening device temporarily engaged with the first end of the elongate woven fabric sheath that is configured for temporary attachment to a golf bag, a belt loop, or a combination thereof.

16. The portable golf glove mounting and drying device of claim 15, wherein the second fastening device is a carabiner clip.

17. The portable golf glove mounting and drying device of claim 13, wherein all outermost surfaces of the elongate woven fabric sheath are water repellent and/or waterproof.

* * * * *